US006739535B2

(12) United States Patent
LaBarbera

(10) Patent No.: US 6,739,535 B2
(45) Date of Patent: May 25, 2004

(54) MOBILE TRASH PULVERIZER

(76) Inventor: Salvatore P. LaBarbera, 4409 Cordero Dr., Eldorado, CA (US) 95762

( * ) Notice: Subject to any disclaimer, the term of this patent is extended or adjusted under 35 U.S.C. 154(b) by 40 days.

(21) Appl. No.: 10/174,546

(22) Filed: Jun. 17, 2002

(65) Prior Publication Data

US 2003/0230656 A1 Dec. 18, 2003

(51) Int. Cl.[7] ..... B02C 19/00; B02C 21/02
(52) U.S. Cl. ..... 241/101.72
(58) Field of Search ..... 100/65, 68, 210; 241/101.72

(56) References Cited

U.S. PATENT DOCUMENTS

| | | | |
|---|---|---|---|
| 3,691,967 | A | 9/1972 | Mettetal, Jr. |
| 4,426,925 | A | 1/1984 | Bergmann |
| 4,467,714 | A | 8/1984 | Bergmann |
| 4,524,685 | A | 6/1985 | Bergmann |
| 5,184,547 | A | 2/1993 | Bergmann |
| 5,195,432 | A | 3/1993 | Bergmann |

FOREIGN PATENT DOCUMENTS

| | | | |
|---|---|---|---|
| DE | 199 18344 | A1 | 2/2000 |
| EP | 1046 490 | A2 A3 | 10/2000 |
| GB | 2 261 832 | A | 6/1993 |

OTHER PUBLICATIONS

Publications: Assorted Enviro Waste Brouchures — all published prior to Jun., 2001.

*Primary Examiner*—Mark Rosenbaum
(74) *Attorney, Agent, or Firm*—Amster, Rothstein & Ebenstein

(57) ABSTRACT

A mobile trash pulverizer for shredding, redistributing and compacting trash in an open top container, includes a self-propelled vehicle for travel on a public street or highway between a plurality of remote sites having open top containers containing trash to be pulverized. A pivot arm system carried by the vehicle supports and moves a reversibly rotatable, generally cylindrical, heavy pulverizing roller between a transport orientation, wherein the roller is on the vehicle with the weight of the roller being substantially borne by the vehicle, and a use orientation, wherein the roller is in a container with the weight of the roller being substantially borne by the container. Rotation of the roller causes it to move along the interior length of the container and thereby shred, redistribute and compact trash therein.

22 Claims, 11 Drawing Sheets

MOBILE TRASH PULVERIZER

BACKGROUND OF THE INVENTION

The present invention relates to pulverizing apparatus for shredding, redistributing and compacting trash in an open top container, and more particularly to such apparatus which is adapted for self-propelled travel on a public street or a highway.

Upwardly open (i.e., open top) containers are typically used to receive various types of waste or trash (e.g., metal, plastic, paper, cardboard and the like), especially at businesses and warehouses, to allow waste accumulation. Once a container has been filled to its volumetric capacity, it is ready for hauling, typically over public streets and highways, to remote waste disposal or landfill sites. A major cost factor in waste disposal relates to this transport of the container back and forth between the collection site and the waste disposal site. Other factors are the charges imposed by the waste disposal site and municipal taxes, the latter typically being based upon the volume (rather than the weight) of the waste dumped.

The uncompacted waste in an open top container comprises various pieces of trash loosely lying on top of each other (compressed only by the weight of the upper layers of trash on the lower layers of trash) so that the overall density of the trash in the container is relatively low. This is especially true of construction debris, which is composed of juxtaposed wood, paper and metal products. Accordingly, the waste capacity of the container is typically limited not by the weight of the filled container (which is usually limited only by the rules on the gross vehicle weight (GVW) of the container-bearing truck and on the transport thereof over public streets and highways), but rather by the interior volume of the container. Due to the high cost involved in the transport of a container to and from the waste disposal site, transport of a volume-limited container is not as efficient as transport of a weight-limited container.

Bergmann, U.S. Pat. Nos. 4,426,925 and 4,467,714, both of which are incorporated herein by reference, disclose apparatus for compacting the trash in such an upwardly open container. These patents disclose a heavy compacting roller which moves to-and-fro on the trash in a container to compact the trash. The compacting roller is mounted on the free end of a pivot arm supported in an articulated manner from a post so that the compacting roller can rotate reciprocatingly and thereby drive itself back and forth over the trash within the container. The post on which the pivot arm (and hence the compacting roller) is mounted is located outside of the open top container, generally closely adjacent either a short end or long side of the container. While such systems effect economies by reducing the number of trips required between the container site and the waste disposal or landfill site (because the container filled with compacted trash contains a much greater weight of trash), such economies are partially offset by the expense involved in dedicating a compactor to each open top container.

More recently, in order to allow for amortization of the cost of the compactor over a number of open top containers at a given collection site, a compactor embodiment having limited mobility over tracks laid in the given collection site has been used to service a plurality of open top containers in the given collection site. External means are used to cause movement of the somewhat mobile compactor embodiment back and forth along the tracks to enable successive servicing of a plurality of open top containers disposed, one after the other, along one side of the tracks in the given collection site.

The degree of amortization provided by the somewhat mobile embodiment is limited by the number of open top containers which would normally be present at any collection site. Typically, the number of open top containers at a collection site does not provide full-time use of a compactor and thus limits the degree of amortization possible. Further, even the limited degree of amortization possible with the somewhat mobile embodiment comes at the price of a centralization of the waste containers at a given waste collection location. In a relatively large business or manufacturing plant of the type which might require a number of open top containers, the waste may be produced at a variety of different locations and then have to be transported to the given collection site containing the open top containers. The result of such a system is a bottleneck at the given collection site as waste is brought there from various other points in the plant as well as the need for an additional layer of transport facilities simply to transport the waste from the various locations at the plant where it is produced to the given collection site where the tracks and the compactor are located.

Accordingly, it is an object of the present invention to provide in one preferred embodiment a fully mobile trash pulverizer suitable for travel on a public street or highway between a plurality of remote trash collection sites having open top containers.

Another object is to provide such a pulverizer which in one preferred embodiment is self-propelled and lawful for use on public streets and highways connecting remote trash collection sites.

A further object is to provide such a pulverizer which in one preferred embodiment has a cost that is amortizable over a plurality of open top containers disposed at a plurality of remote collection sites and does not require a central collection site in a large plant.

It is also an object to provide such a pulverizer which is simple and inexpensive to manufacture, use and maintain.

SUMMARY OF THE INVENTION

It has now been found that the above and related objects of the present invention are obtained in a mobile trash pulverizer for shredding, redistributing and compacting trash in an open top container. The pulverizer comprises a self-propelled vehicle for travel on a public street or highway between a plurality of remote sites having open top containers containing trash to be pulverized. A rotatable, generally cylindrical, heavy roller defines a pair of opposed ends and a circumferential surface connecting the ends, the roller having a plurality of spaced apart cutters (e.g., blades) projecting outwardly from the circumferential surface for pulverizing trash during rotation of the roller. Means are provided for reversibly rotating the roller. Pivot arm means is carried by the vehicle for supporting and moving the roller between a transport orientation, wherein the roller is on the vehicle with the weight of the roller being substantially borne by the vehicle, and a use orientation, wherein the roller is in an open top container with the weight of the roller being substantially borne by the trash within the open top container, whereby rotation of the roller causes the roller to move along the interior length of the open top container and thereby shred, redistribute and compact trash therein.

Preferably, the pulverizer effects a 5:1 volumetric compaction of trash, the roller having a weight of at least 1,000 lbs, preferably at least 1½ tons, and an axial length of about 6 feet.

In a preferred embodiment, the pivot arm means comprises a stationary mast having a first end fixedly secured to the vehicle and a second end projecting distally upwardly thereof, a first arm having a first end pivotally secured to the second end of the mast and a second end extending distally thereof, and a second arm having a first end pivotally secured to the second end of the first arm and a second end extending distally thereof and secured to the roller. Preferably, the pulverizer additionally includes means for enabling limited free pivotal movement of the second arm relative to the first arm and the first arm relative to the mast, such that the roller can move to-and-fro along the interior length of the open top container. The pivot arm means is configured and dimensioned to enable the roller to move to-and-fro along substantially the entire interior length of the container at the height of the interior floor of the container.

Preferably, the pulverizer additionally includes a manually actuatable hydraulic ram having a first end pivotally mounted on the mast and a reciprocating second end operatively secured to the first arm (via a paddle) for raising and lowering the same. The paddle has two opposed ends and a center therebetween, one end of the paddle being pivotally secured to the ram second end, the center of the paddle being pivotally mounted on the mast second end, and the opposite end of the paddle freely bearing against the first arm first end, whereby the paddle allows the first arm second end to freely float upwardly and downwardly relative to the mast while limiting the effect of upward movement of the ram second end. Preferably the first arm defines a dogleg adjacent the first end thereof such that, when the first arm is in a generally upright orientation, the second arm second end is closer to the front of the vehicle than it would without the dogleg, thereby to enable the roller in the container to reach closer to the proximal end of the container than it would without the dogleg, and, when the first arm is in a generally horizontal orientation, the roller to be in the transport orientation.

The first arm adjacent the second end and the second arm adjacent the first end cooperatively define facing arm bumpers projecting toward one another to prevent the roller from contacting the mast and the ram. Arm attachment means releasably lock together the first and second arms, the arm attachment means being operative during movement of the roller between the use orientation and the transport orientation and during motion of the vehicle. The arm-attachment means is a preferably pintle hook-and-eye system, including a manually releasable lock on the hook.

In another preferred embodiment, the vehicle has a front axle mounting a pair of wheels and two rear axles, each rear axle mounting a pair of wheels, the mast means being mounted on the vehicle intermediate the two rear axles and inboard of the rear axle wheels. When the roller is in the transport orientation, the junction of the first arm and the second arm projects rearwardly behind the back of the vehicle (i.e., the vehicle bumper) by not more than ⅔ of the wheel base of the vehicle, and the maximum height of the pulverizer is less than 13 feet, 9 inches above the ground. The vehicle preferably defines at the upper rear thereof a gatorback formed of a plurality of transversely extending ridges increasing in height toward the front of the vehicle, whereby, when the roller is properly positioned and rotating in the proper direction, the roller will at least partially crawl up the gatorback.

The present invention also encompasses, in combination, the pulverizer and an open top container containing trash.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

in FIG. 2 the roller is in a partial transport orientation in solid line and in the full transport orientation in phantom line;

DETAILED DESCRIPTION OF THE PREFERRED EMBODIMENTS

Figure 1:
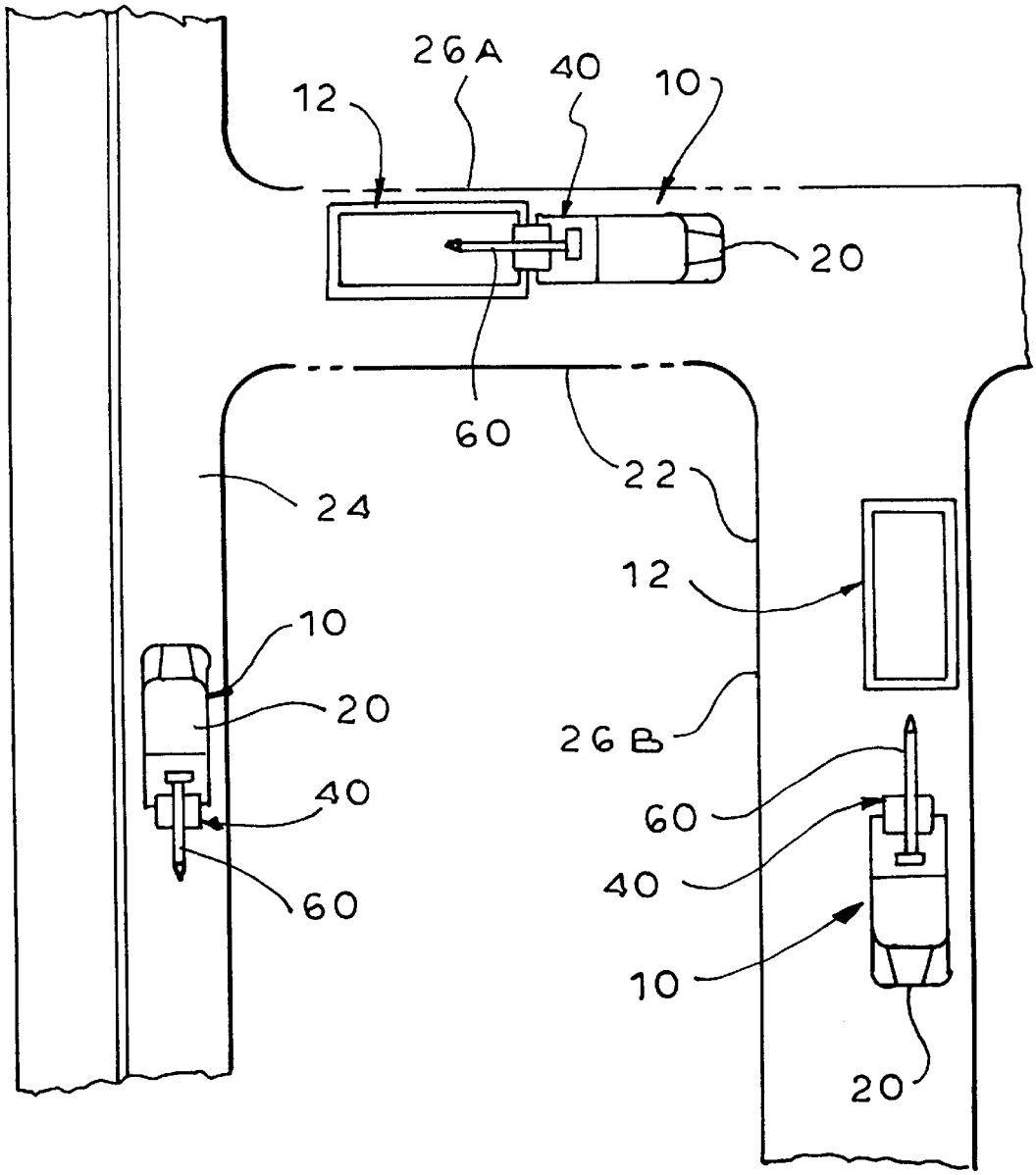
FIG. 1 is a fragmentary schematic top plan view of a hypothetical travel path of a pulverizer on public highways and streets between a plurality of remote collection sites.

Referring now to the drawing, and in particular to FIG. 1 thereof, therein illustrated is a mobile trash pulverizer according to the present invention, generally designated by the reference numeral 10. The pulverizer 10 is configured and dimensioned to shred, redistribute and compact trash in an open top container, generally designated 12, with upright side and end walls having a typical height of about 9 feet.

The pulverizer 10 includes a self-propelled vehicle 20 suitable for lawful travel on public streets 22 or public highways 24 (referred to as "public highways and byways") between a plurality of remote sites 26A, 26B (either on the public streets or adjacent thereto). Each of the remote sites 26A, 26B contains at least one and possibly a plurality of open top containers 12 containing trash to be pulverized.

For lawful travel on public streets and highways a vehicle must comply with various laws, rules and regulations governing vehicular travel—i.e., governing the weight and dimensions of the vehicle, its speed on public highways, and the like. The weight limitation is usually given on a "weight per axle" basis so that the total weight of the vehicle is distributed over the various axles (thereby to minimize damage to the road surface). With regard to dimensions, the vehicle is limited to a maximum height (so that it may pass under overpasses), a maximum width (so that it fits within a single lane of traffic), and a maximum projecting length (so that it does not have any portion thereof projecting rearwarely of the rear bumper by more than a given length, thereby to minimize danger to the vehicle immediately therebehind). Many of the aforesaid weight and dimension limitations are applicable to vehicles on public streets as well as public highways. Of particular importance to public highways, however, is the ability of the vehicle to proceed at a lawful rate of speed. This requirement usually involves the ability of the vehicle to meet a minimum speed or otherwise travel at a rate which does not interfere with the general flow of traffic on the public highway. The various laws, rules and regulations may vary from state to state, county to county, municipality to municipality and even highway to highway. Those that are specifically referenced herein are those set by and within the State of California.

Figure 2:
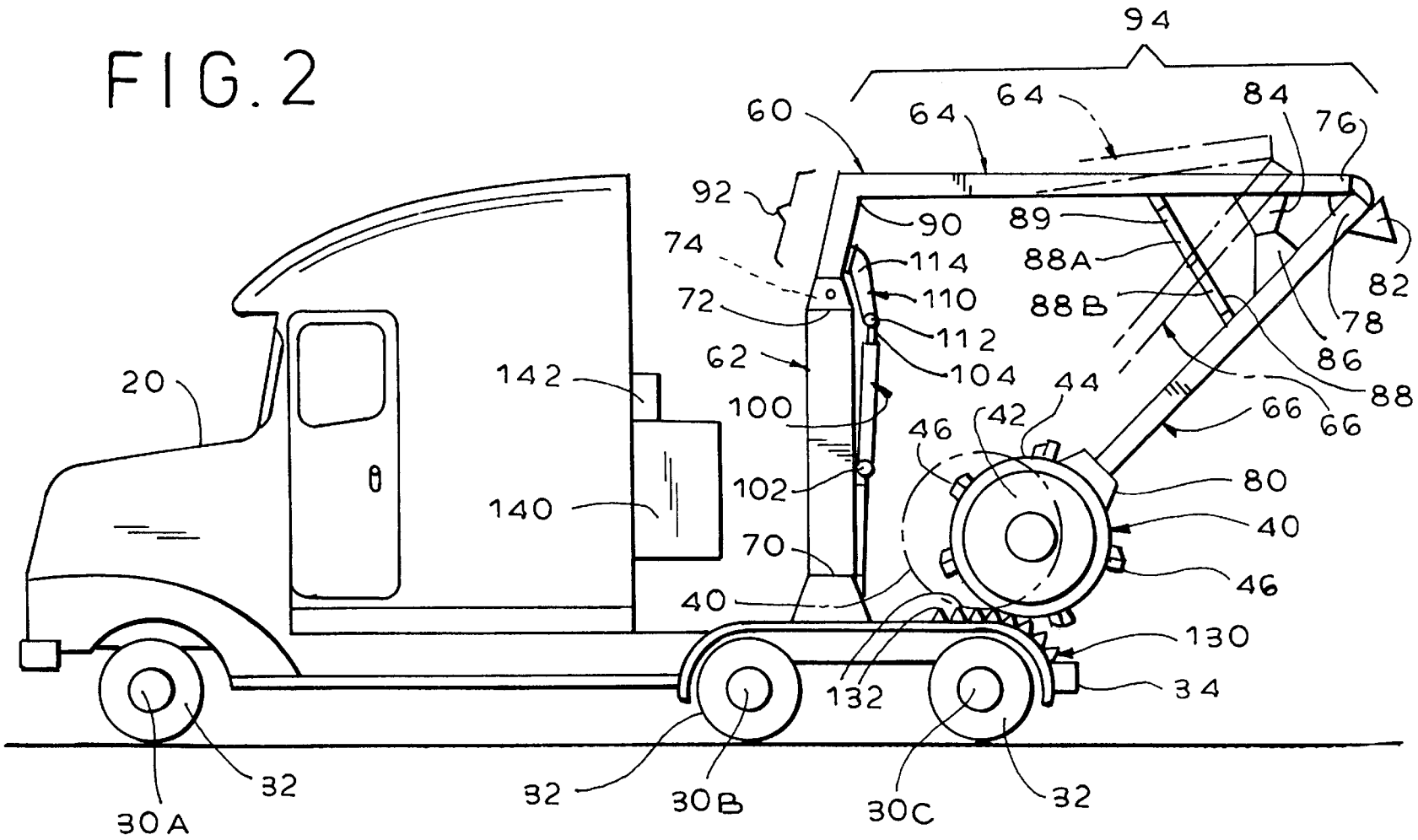
FIGS. 2 and 3 are side elevational and top plan views, respectively, of the pulverizer.
Figure 3:
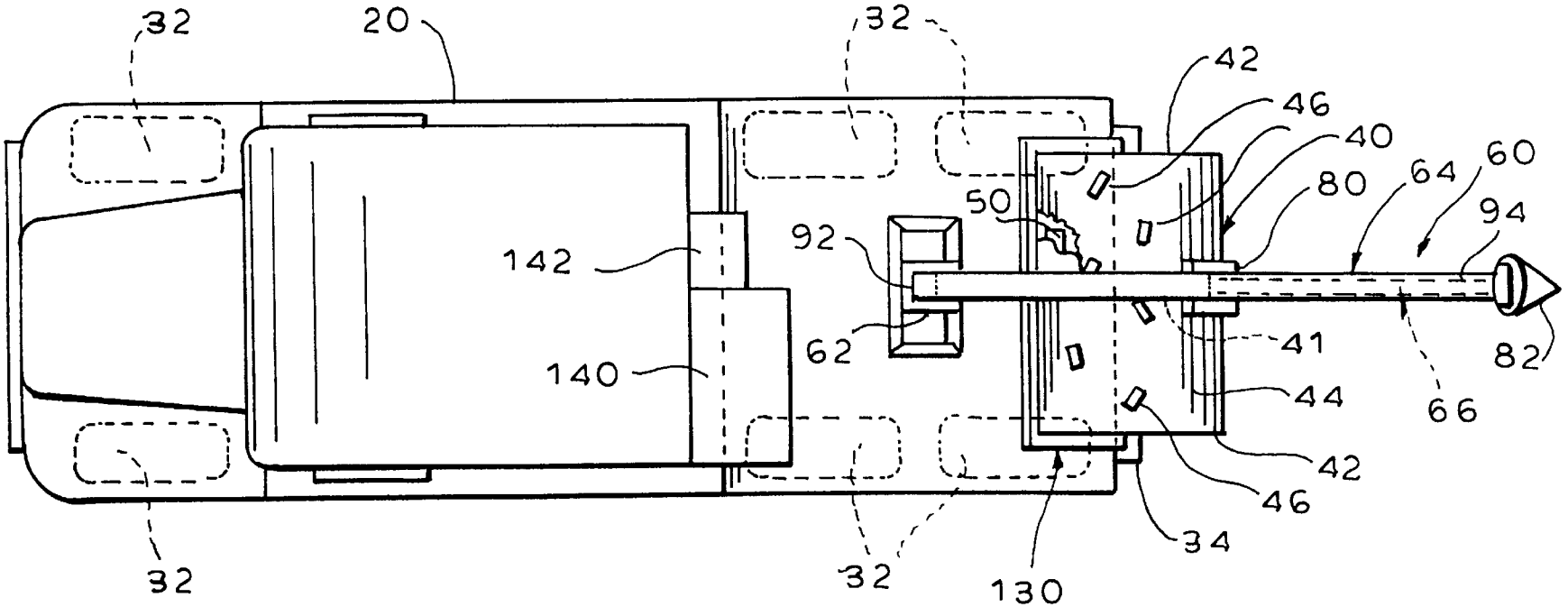

Referring now to FIGS. 2 and 3 in particular, therein illustrated is a vehicle 20 having a front axle 30A and a pair of wheels 32A mounted thereon, and two rear axles 30B and 30C, each rear axle 30B, 30C having at least one pair of wheels mounted thereon. Optionally, each axle 30A–30C may have more than a single pair of wheels mounted thereon. Preferably, the vehicle 20 is a three axle truck with a front engine and an open back bed, such as that available from a variety of truck-tractor manufacturers under such trade names as Freightliner CENTURY or STANDARD, Ford AEROMAC or other designations from Mack, Peterbilt, Volvo and Kenworth. The rear end of vehicle 20 is preferably outfitted with a substantial or oversized rear bumper 34 so that, in the event of impact between the vehicle 20 and a container 12 as the vehicle 20 is backed up close to the container 12, there is little, if any, damage to either.

Propulsion of the vehicle 20 over the streets 22 and highways 24 may be achieved by any of the conventional means (not shown) including motors operating on gasoline, diesel fuel or batteries. During travel, the pulverizer 10 must be capable of safely navigating the highways and streets at a speed which is lawful and preferably does not interfere with the flow of traffic thereon. Travel on a public highway in State of California is governed by a minimum speed requirement such that the vehicle "not . . . impede traffic."

The pulverizer 10 additionally includes a rotatable, generally cylindrical, heavy roller, generally designated 40. The roller 40 is drum-like in appearance and defines a non-rotatable thin central segment 41 and a pair of opposed end segments 42, one to either side of central segment 41 and rotatable relative thereto. Central segment 41 and end segments 42 together define a circumferential surface 44. The roller 40 has a weight of at least 1,000 lbs, preferably at least 1½ tons, a diameter of about 4 feet and an axial length of about 6 feet.

The roller 40 has a plurality of spaced apart cutters 46 projecting outwardly from the circumferential surface 44 for pulverizing (i.e., shredding, redistributing and compacting) trash during rotation of the roller 40. Ideally, the configuration, dimensions and placement of the cutters 46 is determined by the type of trash to be pulverized by the pulverizer 10. Thus, where the trash is structurally strong material (for example, because it includes metal pieces), the cutters are preferably tetrahedral in order to provide the necessary strength. Where the trash is of lesser structural strength (e.g., more easily pulverized wood or cardboard), the cutters are preferably trihedral. Where the trash is easily pulverized (e.g., paper), the cutters may simply be sharp planar projections or blades. Where the trash is enclosed in fragile plastic trash bags and it is desired not to break or fracture the bags, the cutters may be a series of blunt blades extending parallel to the longitudinal axis of the roller 40 so that the trash is redistributed and compacted within the container 12, hopefully without damaging the trash bags. In many instances the trash will include a variety of different types of trash, and appropriate compromises in the design of the cutters 46 will be required.

It will be appreciated that the pressure (e.g., pounds per square inch) exerted by the cutters 46 far exceeds the actual weight of the roller 40 in view of the relatively small areas contacting the trash The weight borne by the cutters 46 includes not only the weight of the roller 40, but also the weight of certain elements of the novel pivot arm means 60 to be described hereinafter.

The pulverizer 10 additionally includes means for reversibly rotating the roller 40, such as a motor, generally designated 50, for rotating the end segments 42 of roller 40 about its longitudinal axis. The motor 50 is partially visible in FIG. 3 through the cutaway portion of the roller circumferential surface 44. The motor 50 may be electrical or hydraulic in nature, but a hydraulic motor is preferred because it is better able to withstand the stalling which may occur when the roller encounters an object in the trash which resists pulverizing and, in effect, stalls the motor. While an electric motor is also suitable, stalling of an electrical motor may damage the electrical armature thereof.

Reversal of the direction of rotation of the roller 40 may be achieved in a variety of different ways. The object, of course, is to allow the roller 40 to travel substantially the entire interior length of the container 12 (at any height above the interior floor of the container 12), preferably without coming into contact with the interior end walls (or, for that matter, the interior sidewalls of the container 12).

At the low end of the technological spectrum, the person supervising the pulverizing operation may control the direction of rotation using a simple push button, which effects a reversal of the direction of rotation for each actuation. Where a given pulverizer will be used only with containers 12 having a common interior length, the preferred switch-over points in rotation direction may be empirically determined and then set into limit switches which govern the rotation of the roller. At the high end of the technological spectrum, where a given pulverizer will be used with containers of differing interior lengths, resettable limits may be set into limit switches by a supervisor based on the initial travel of the roller in each container.

Preferred rollers 40 for use in the present invention are described in Bergmann U.S. Pat. Nos. 4,426,925 and 4,467,714, as are the means for reversibly rotating the rollers 40, except that the aforementioned patents teach electric motors rather than hydraulic motors and use a relatively complex limit switch system to control the direction of rotation.

Typically a container 12 has an exterior width of about 8 feet, this being limited by the permissible container width for travel on the public highways and streets according to state law. Accordingly, the roller 40 preferably has an axle length of about 6 feet, thereby leaving almost a foot of clearance as a margin on each side within the interior of the container 12. Similarly, the potential travel path of the roller is preferably up to about 22 feet, although this may be limited to provide a margin of safety for the proximal and distal interior end walls of the container 12 and to provide compliance with state law limitations on how far the pivot arms means to be described hereinafter may extend behind the rear of the vehicle 20. Nonetheless, the rotation of the roller 40, as it travels along substantially the entire interior length of the container 12, results in not only in shredding and compacting of the trash therein, but also a redistribution of the trash therein such that trash in the side and end marginal areas is periodically drawn into the travel path of the roller 40 for shredding and compacting.

Having described hereinabove the vehicle 20 and the roller 40 (including the means 50 for reversibly rotating the roller 40), we turn now to the pivot arm means, generally designated 60. The pivot arm means 60 is carried by the vehicle 20 for supporting and moving the roller 40 between a transport orientation, wherein the roller 40 is on the vehicle 20 with the weight of the roller 40 being substantially borne by the vehicle 20, and a use orientation, wherein the roller 40 is in a container 12 with the weight of the roller 40 being substantially borne by the container 12.

Referring now also to FIGS. 4A through 7B in particular, the pivot arm means 60 is of a novel design and comprises a stationary mast generally designated 62, a first arm generally designated 64, and a second arm generally designated 66. Mast 62 replaces the turntable on the back of the conventional truck-tractor. The mast 62 has a first end 70 fixedly secured to the vehicle 20 (and in particular the bed constituting the top rear of the vehicle 20) and a second end 72 projecting distally upwardly therefrom; the first arm 64 has a first end 74 pivotally secured to the second end 72 of the mast 62 and a second end 76 extending distally thereof; and the second arm 66 has a first end 78 pivotally secured to the second end 76 of the first arm 64 and a second end 80 extending distally thereof and secured to the roller 40. The mast first end 70 is fixedly secured to the frame of vehicle 20, intermediate the front axle 30A and rear axle 30*c*, preferably between the two rear axles 30B, 30C, inboard of the wheels 32. Preferably a flag or other highway warning sign 82 (whether illuminated or not) is secured to the pivot arm means 60 adjacent the pivot point joining the first arm second end 76 and the second arm first end 78 (i.e., the rearmost portion of the pivot arm means 60 when the roller 40 is in the transport orientation) as a warning to vehicles following the pulverizer 10 on the highways or streets.

The mast 62, the first arm 64 and the second arm 66 are each substantially rigid, although they are pivotally secured to one another. Thus, the connecting or pivot means allows limited free pivotal movement of the second arm 66 in either direction relative to the first arm 64 and limited free pivotal relative of the first arm 64 in either direction relative to the mast 62, such that the roller 40 can move to-and-fro along the interior length of the container 12 atop the varying height of the trash therein.

Figure 4A:
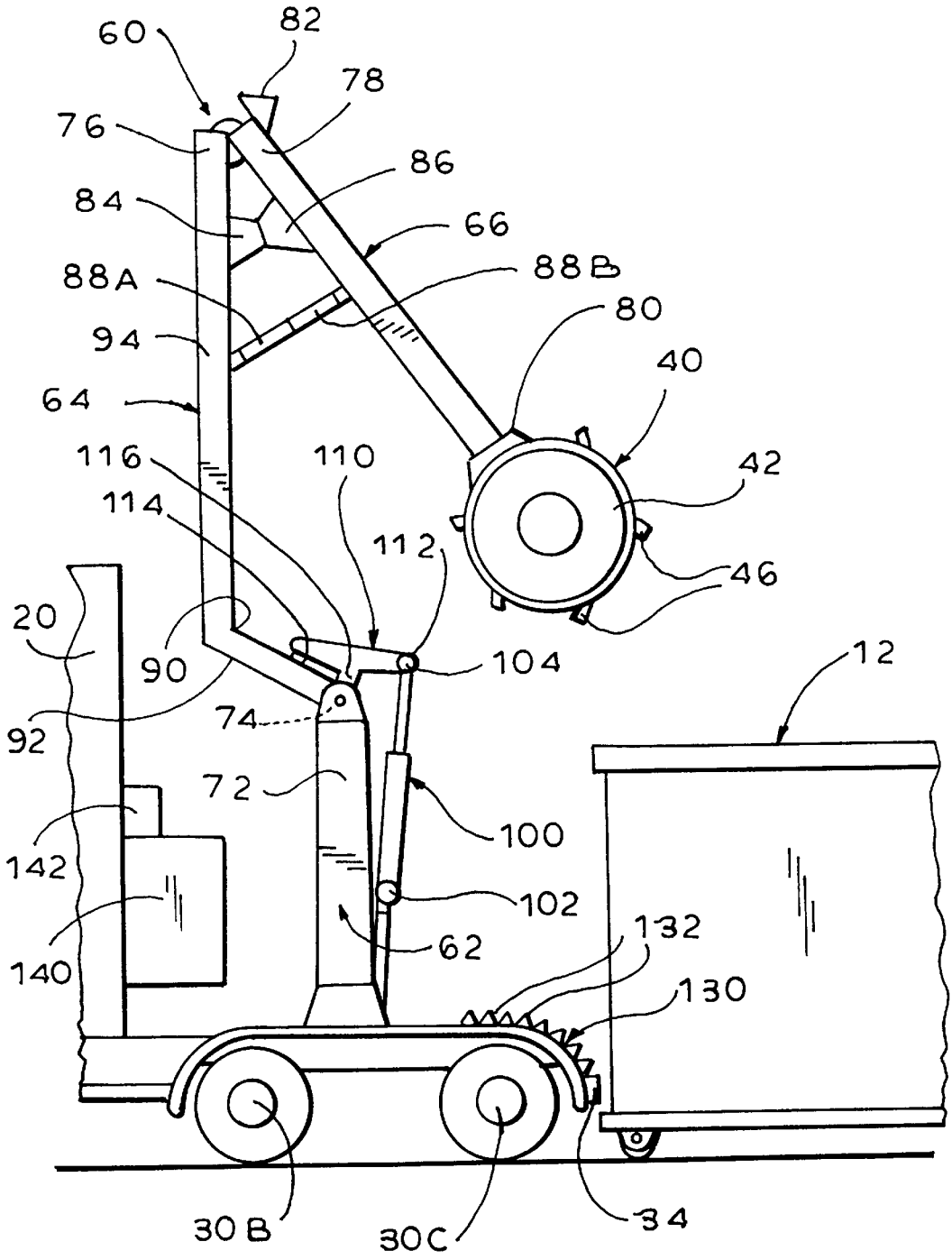
FIG. 4A is a fragmentary side elevational view of a pulverizer with the compacting roller midway between the transport and use orientations.

The pulverizer 10 additionally includes a pair of arm bumpers 84, 86. The first arm 64 (preferably adjacent the second end 76 thereof) and the second arm 66 (preferably adjacent the first end 78 thereof) define arm bumpers 84, 86, respectively. These arm bumpers 84, 86 face and abut one another when the roller 40 is in or nearly in the transport orientation (FIGS. 2 and 4A) and generally project towards one another sufficiently to prevent the second arm 66 from approaching the first arm 64 so closely that the roller 40 (at the second end 80 of the second arm 66) deleteriously contacts the mast 62 and a hydraulic ram 100 secured thereto. Arm bumpers 84, 86 are most needed when the second end 76 of the first arm 64 is at its highest, as illustrated in FIG. 4A, and the weight of the roller 40 pivots the second arm 66 downwardly and towards the front of the vehicle 20. The danger is therefore highest during movement of the roller 40 between the transport and use orientations.

The pulverizer 10 additionally includes arm attachment means 88 for releasably locking together the first and second arms 64, 66. The arm attachment means 88 is preferably located slightly below the arm bumpers 84, 86 and is only operative during movement of the roller 40 between the use orientation and the transport orientation (see FIG. 4A) and, as a safety measure, also during motion of the vehicle 20 with the roller 40 in the transport orientation (see FIG. 2).

At the low end of the technological scale, the arm attachment means 88 may simply be a heavy chain used to secure the first and second arms 64, 66 together in a relatively close orientation. At the high end of the technological spectrum, the arm attachment means 88 may be a pintle or hook-and-eye system, as illustrated, preferably including a manually releasable (optimally solenoid-actuated) lock 89 on the hook. The hook 88A extends from one of the first and second members 64, 66 towards the eye 88B, while the eye 88B extends from the other of the first and second members 64, 66 towards the hook 88A. Engagement of the hook 88A and eye 88B may be automatic as the first and second members 64, 66 enter a relatively close relative orientation, and release of the engagement of the hook and eye may also be automatic, upon manual release of the lock on the hook (e.g., via solenoid actuation), so that the first and second arms 64, 66 may move to a relatively more remote relative orientation once it is safe to do so.

In the novel pivot arm means 60 of the present invention, the first arm 64 defines a dogleg 90 which divides the first arm 64 into a shorter proximal portion 92 relative to mast 62 and a relatively longer substantially linear distal portion 94 relative to mast 62. The dogleg 90 is an angle of about 120°–130°, preferably 130°. Except for the dogleg 90 in the first arm 64, the basic elements of the pivot arm means 60—that is, the mast 62, the first arm 64 and the second arm 66—are generally linear along their longitudinal axes and thus may be easily provided with high structural strength and rigidity.

The dogleg 90 performs various significant functions. When the first arm distal portion 94 is in a generally upright orientation (see FIGS. 4A and 4B), the dogleg 90 permits the second end 80 of the second arm 66 to be closer to the rear of the vehicle 20 than it would be without the dogleg 90. This enables the roller 40 to subsequently enter into the container 20 close to the proximal end of the container 20. The dogleg 90 also permits the first arm distal portion 92 to achieve a generally horizontal orientation (see FIG. 2) such that the roller 40 can achieve the transport orientation and thereby lower the center of gravity of the entire pulverizer 10. The dogleg 90 further enables the pivot arm means 60 to be configured and dimensioned to enable the roller 40 to move to-and-fro along substantially the entire length of the interior floor of the container 12, the level of trash therein permitting (see FIGS. 5A through 7B). A further function of the dogleg 90 is to enable the pivot arm means 60 to function (e.g., to clear the proximal end wall of container 12) without any telescopic activity of the type required by the pivot arms of the aforementioned Bergmann patents—that is, without any telescoping of an arm secured to the roller or any telescoping of an arm secured to the mast.

The pulverizer 10 additionally includes a manually actuatable ram, generally designated 100. The ram 100 has a first or bottom end 102 pivotally mounted on the mast 62 and a reciprocating second or top end 104 operatively secured to the first arm proximal end 92 (below the dogleg 90) for raising and lowering the first aim 64. The ram 100 is illustrated as a conventional hydraulic cylinder-and-piston system, but clearly a variety of different means may be employed for raising and lowering the first arm 64, including non-hydraulic rams, screw rams and the like.

The first or bottom end 102 of the ram 100 (that is, the proximal end of the cylinder of the cylinder-and-piston system) is pivotally secured to the mast 62, preferably adjacent the bottom or first end 70 thereof, so that the ram 100 is capable of moving between a generally parallel orientation to the mast 62 (see FIGS. 2 and 6A through 7B) and a transverse orientation thereto such that the ram 100 and mast 62 define an acute angle adjacent the bottoms thereof (see FIGS. 4A through 5B). Activation of the ram 100 to the extended position is required only at the commencement and termination of the pulverizing operation, the bulk of the pulverizing operation being conducted without reference to the ram 100—that is, with the ram in a retracted position such that it does not limit relative movement of first arm 64 relative to mast 62.

As noted above, the reciprocating second end 104 of the ram 100 (that is, the distal end of the piston of the cylinder-and-piston system) is operatively secured to the first arm 64. The reciprocating second end 104 acts indirectly on the first arm proximal portion 92 via an intermediate member, generally designated 110. Intermediate member 110 is referred to herein as a "paddle" and is preferably functionally shaped as a triangle, and optimally an isosceles triangle. The paddle 110 has two opposed ends 112, 114 (the vertices of the triangle) and a center 116 (the apex of the triangle) therebetween. The bottom end 112 of the paddle 110 is pivotally secured to the ram second end 104; the center or apex 116 of the paddle typically 110 is pivotally mounted on the mast second end 72; and the upper end 114 of the paddle 110 defines an enlarged contact plate 117 which at times freely bears against the first arm proximate portion 92 and at times is spaced therefrom.

The apex 116 of the paddle 110 may pivot about the same pivot axis as that connecting the mast 62 and the first arm 64, or another pivot axis preferably adjacent and parallel thereto. As the apex 116 is the pivot point for movement of the paddle 110, it will be appreciated that, as the reciprocating second end 104 of the ram 100 (i.e., the distal end of the piston thereof) extends upwardly out of the cylinder and bears upwardly with it the paddle bottom end 112, both the ram second end 104 and the paddle bottom end 112 pivotally secured thereto must also move laterally outwardly from the longitudinal axis of the mast 62 in order to accommodate the greater overall effective length of the ram 100. Outward and upward movement of the paddle bottom end 112 causes rearward movement of the paddle upper end 114 toward the front of the vehicle 20 (i.e., pivoting of the paddle 115 about its apex 116). When the ram 100 is in the retracted position so that the ram second end 104 and the paddle bottom end 112 are closely adjacent the longitudinal axis of the mast 62 (see FIGS. 2 and 6A through 7B), the ram 100 is more nearly parallel to the longitudinal axis of the mast 62 and the paddle top end 114 barely touches, if at all, the first arm proximal portion 92, even when the roller 40 is in the transport orientation illustrated in FIG. 2.

On the other hand, as the ram 100 becomes fully extended (see FIGS. 4A and 4B), the paddle 110 pivots about its apex 116 so that the upper end 114 bears against and moves the first arm proximal portion 92, thereby to lift the first arm distal portion 94 to a substantially upright orientation. In this position of the pivot arm means 60, the weight of the roller 40 acts to bring the second arm 66 downwardly so that the roller 40 approaches the ram 100 and mast 62. However, as mentioned earlier, the arm bumpers 84, 86 limit motion of the second arm 66 and roller 40 in that direction to prevent damage to the ram 100 and mast 62. The roller 40 is now positioned at a height above that of the proximal end wall of container 12 (see FIGS. 4A and 4B).

Figure 5A:
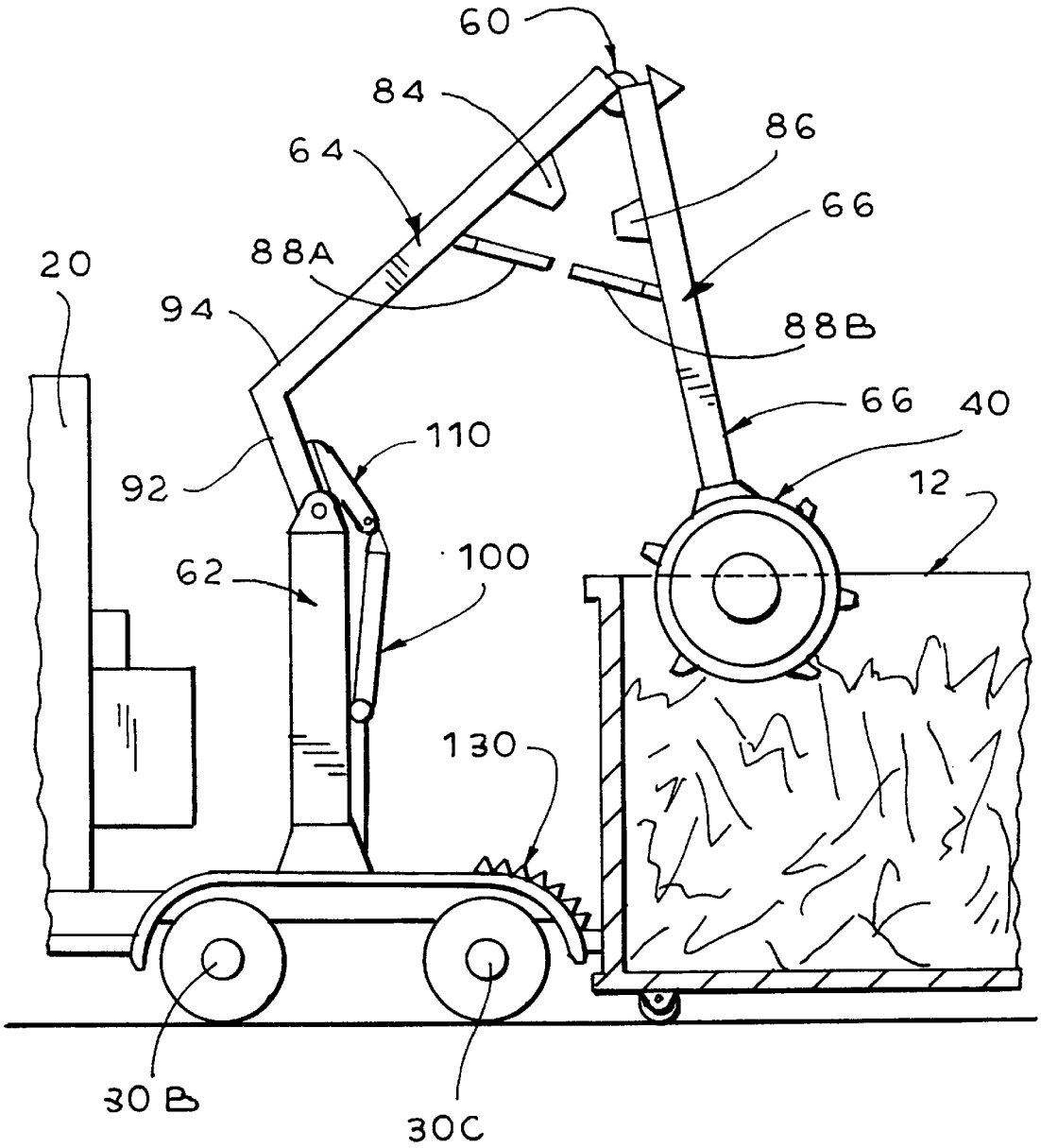
FIG. 5A is a fragmentary side elevational view of the pulverizer in action with the roller at the near end of an initial compacting stroke in a container.
Figure 5B:
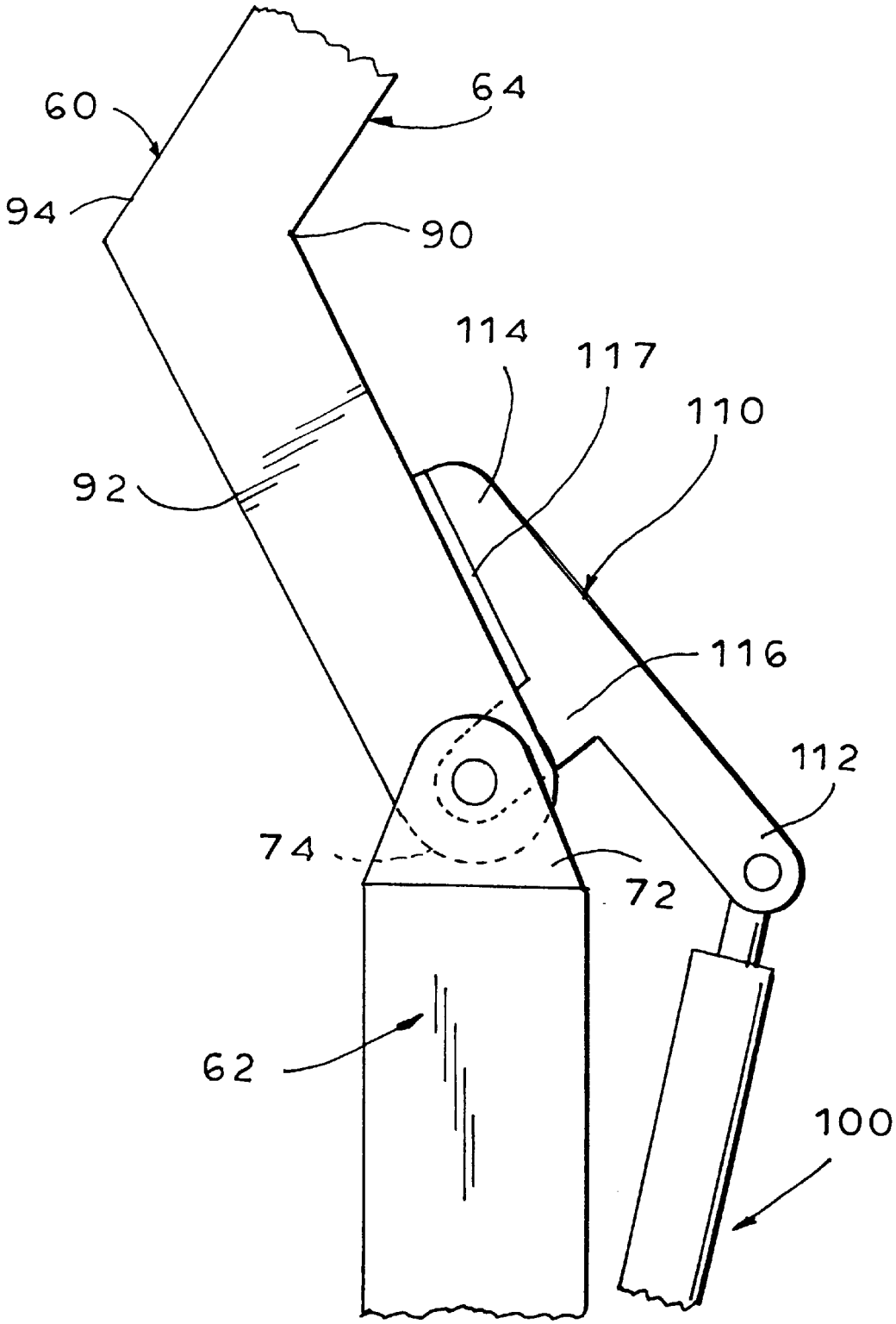
FIG. 5B is a fragmentary enlarged schematic thereof.
Figure 6A:
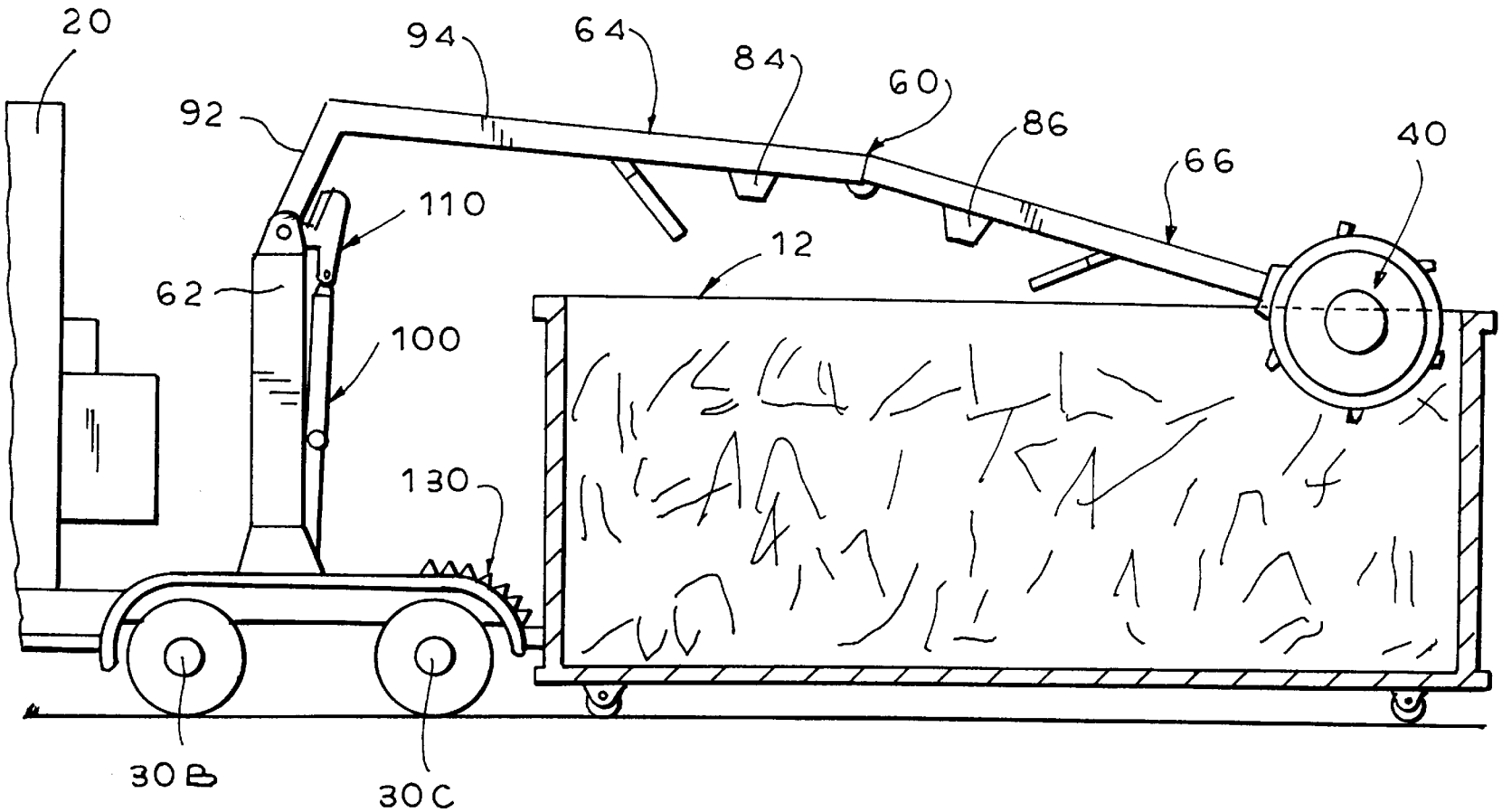
FIG. 6A is a fragmentary side elevational view of the pulverizer in action with the roller at the far end of an initial compacting stroke in a container.
Figure 6B:
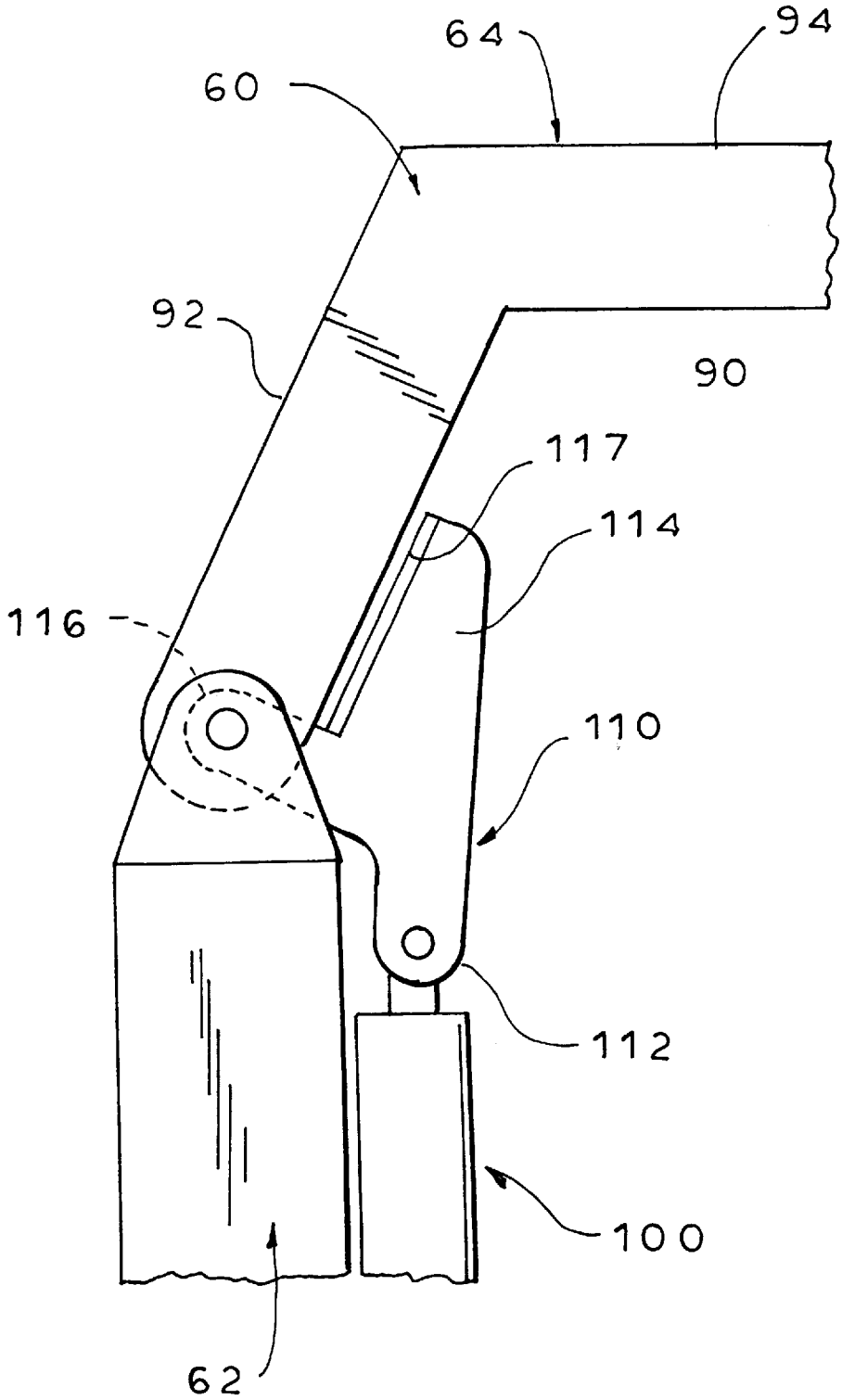
FIG. 6B is a fragmentary enlarged schematic thereof.
Figure 7A:
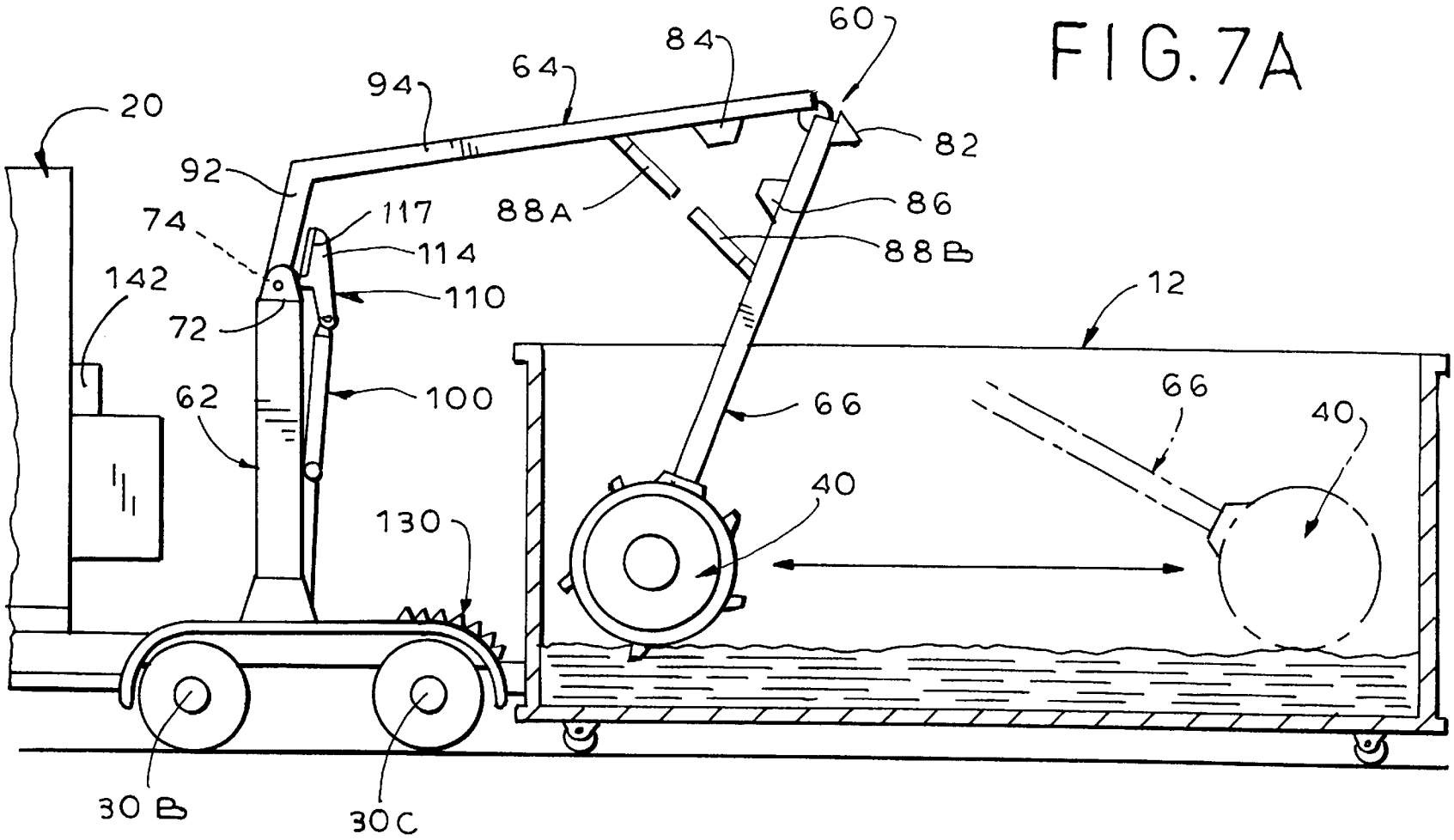
FIG. 7A is a view similar to FIGS. 5A and 6A, but showing the pulverizer with the roller at the proximal end of a compacting stroke in solid line after the trash has been fully compacted, the roller being shown at the distal end of the compacting stroke in phantom line.
Figure 7B:
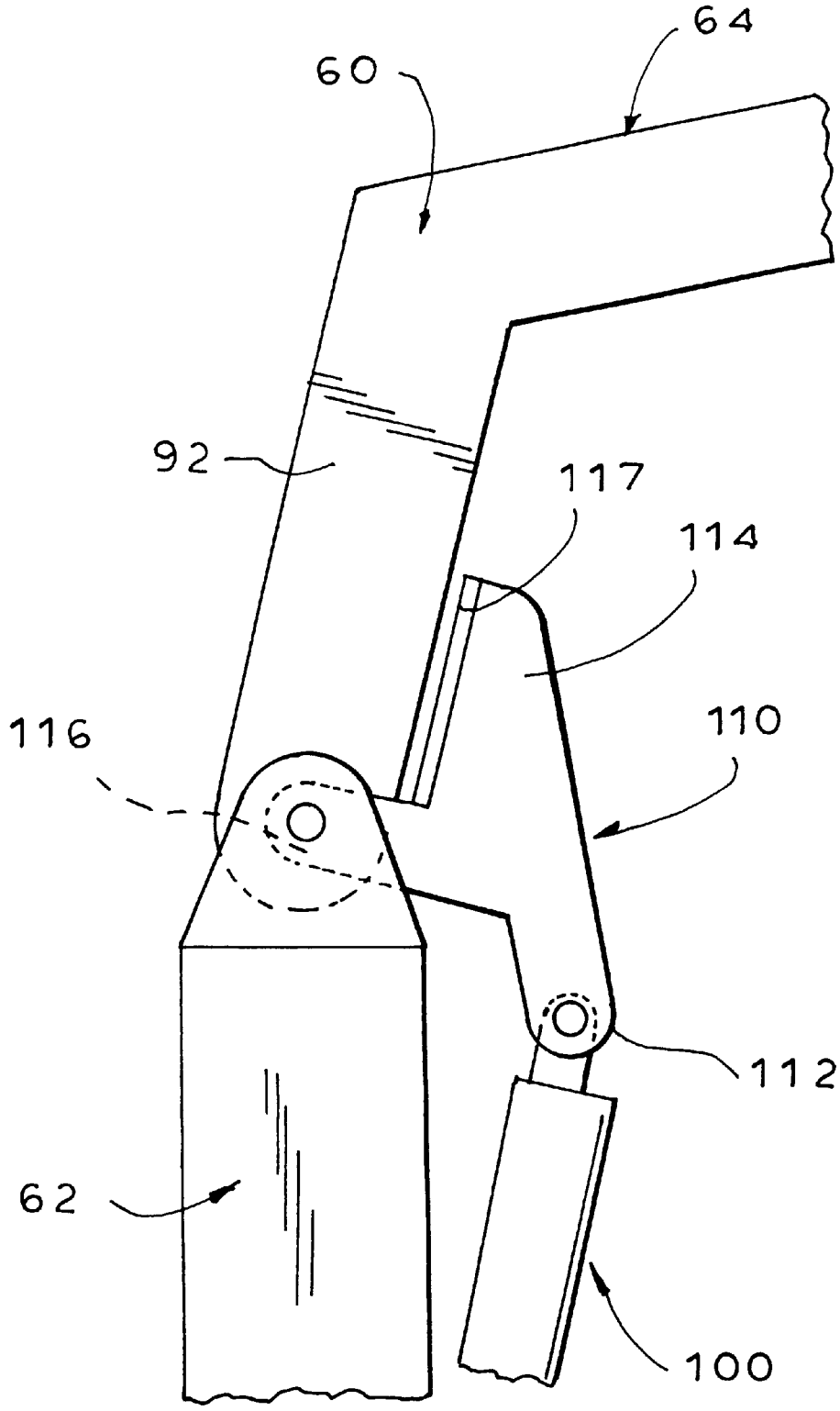
FIG. 7B is a fragmentary enlarged schematic thereof.

At this point, the pulverizer 10 is moved closer to the proximal end wall of the container 12, ideally until the rear bumper 34 of vehicle 20 just comes into contact with the proximal end of container 12 (see FIGS. 5A and 5B). Once the pulverizer 10 and container 12 are in the appropriate relative position, the lock 89 on arm attachment means 88 is manually released, and the ram 100 is slowly retracted as the arm attachment elements 88A, 88B separate. This results in the roller 40 descending into the container 12 adjacent the proximal end wall of the container 12. The first arm distal portion 94 assumes a generally horizontal orientation as the roller 40 begins to rest upon the top layer of the uncompacted trash within the container 12. The precise orientation of the first arm distal portion 94 will depend upon various factors including the depth of the trash within the container 12, the position of the roller 40 along the interior length of the container 12, etc. Preferably the roller 40 is not deployed unless there is at least two feet of uncompacted trash in the container 12 in order to protect the interior floor of the container 12.

While it may not be necessary for the ram 100 to assume its fully retracted state initially, presumably the same will eventually become necessary both as the level of trash is lowered by successive compressive travels of the roller 40 thereover and as the roller 40 moves towards the distal interior end of the container 12 during each travel of the roller 40 (see FIGS. 6A through 7B). Accordingly, it is preferred to retract the ram 100 all the way to its fully retracted position initially (see FIGS. 6A and 6B) so that it does not later interfere with the free pivoting of the first arm 64 in response to the movement of the roller 40 to-and-fro and/or lowering of the level of trash within the container 12.

Figure 4B:
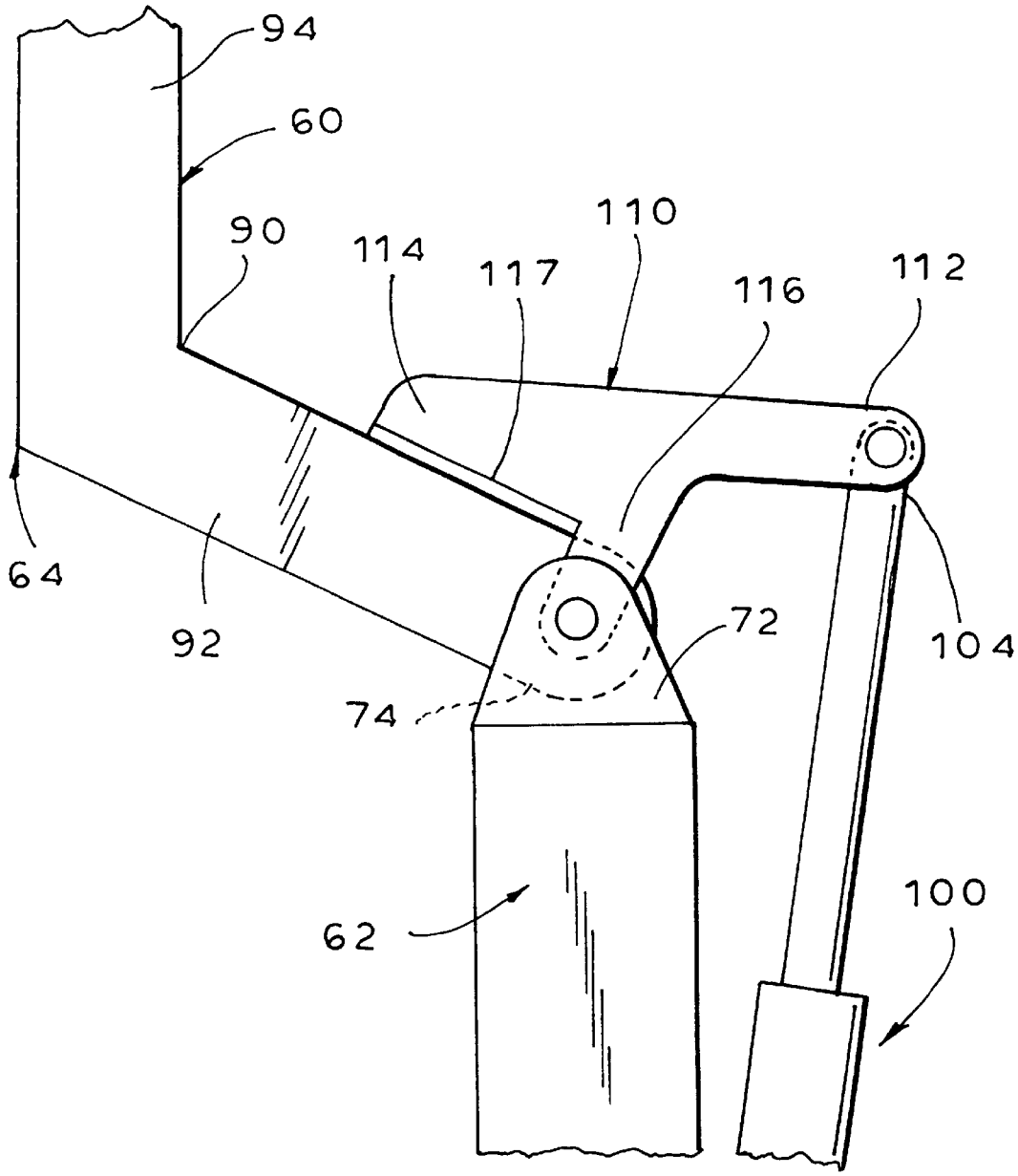
FIG. 4B is a fragmentary enlarged schematic thereof.

Once the trash has been pulverized to the satisfaction of the operator (see FIGS. 7A and 7B), the ram 100 is actuated to its fully extended state (preferably while the roller 40 is adjacent the proximal end wall of container 12) so that the ram second end bears on and moves the first arm proximal portion 92 forwardly, thereby to raise the first arm distal portion 94 and elevate the roller 40 above the height of the container proximal end wall (see again FIGS. 5A and 5B and then FIGS. 4A and 4B). As the second arm 66 moves forwardly (towards the front of vehicle 20), the arm attachment means 88 eventually actuates itself to fix the close relative juxtaposition of the first and second arms 64, 66. At this point the pulverizer 10 is moved forwardly (away from the container 12) so that the container 12 will not interfere with movement of the roller 40 to the transport orientation and the concomitant movement of the second arm 66. Ram 100 is then fully retracted. With the arm attachment means 88 becoming actuated during retraction of the ram 100, the roller 40 will be deposited on the rear of vehicle 20 (see again FIGS. 2 (solid line) and 3).

The vehicle 20 preferably defines at the upper rear thereof a gatorback 130, as illustrated in FIG. 2. The gatorback 130 is formed of a plurality of transversely extending ridges 132 extending from adjacent one side of the vehicle 20 to adjacent the other side and increasing in height above the ground from the rear of the vehicle 20 towards the front thereof. Thus, when the roller 40 is in contact with the gatorback 130 and then rotated in the proper direction (counterclockwise as illustrated), the roller 40 will at least partially crawl further up the gatorback 130 (as the cutters 46 engage the ridges 132) and thus move towards the front of vehicle 20. Roller rotation is terminated upon the roller 40 reaching the full transport orientation (see phantom line in FIG. 2). Once the roller 40 is in the full transport orientation, it may, if desired, be further secured for transport purposes. When the roller 40 is in the transport orientation, the junction of the first and second arms 64, 66 preferably projects rearwardly behind the back of the vehicle 20 (i.e., the bumper) by not more than ⅔ of the wheel base, and the total height of the pulverizer is less than 13 feet, 9 inches above the ground. The gatorback 130 ensures that the roller 40 in the transport orientation is as close to the front of the vehicle as possible so that the vehicle 20 is stable, with a low center of gravity, not withstanding the heavy load placed thereon by the roller 40.

The transport 20 of the pulverizer 10 is preferably outfitted with a diesel generator 140 to meet the electrical energy requirements of the pulverizer and a power pack 142 including an oil pump (not shown) for providing hydraulic power for the ram 100 and the motors within the roller 40.

To summarize, the present invention provides a fully mobile trash pulverizer suitable for travel on the public street or highway between a plurality of remote trash collection sites containing open top containers, the pulverizer being self-propelled and lawful for use on public streets and highways connecting such remote trash collection sites. The cost of the pulverizer is amortizable over a plurality of open top containers disposed in such plurality of remote trash collection sites, and use of a pulverizer does not require a central collection site in a large plant.

Now that the preferred embodiments of the present invention have been shown and described in detail, various modifications and improvements thereon will become readily apparent to those skilled in the art. Accordingly, the spirit and scope of the present invention is limited only by the appended claims, and not by the foregoing specification.

I claim:

1. A mobile trash pulverizer for shredding, redistributing and compacting trash in an open top container, comprising:

(A) a self-propelled vehicle configured and dimensioned for lawful travel on a public street or highway, at or above a legal minimum speed, between a plurality of remote trash collection sites having open top containers containing trash to be pulverized;

(B) a rotatable, generally cylindrical, heavy roller defining a pair of opposed ends and a circumferential surface connecting said ends, said roller having a plurality of spaced apart cutters projecting outwardly from said circumferential surface for pulverizing trash during rotation of said roller;

(C) means for reversibly rotating said roller; and (D) pivot arm means carried by said vehicle for supporting and moving said roller between a transport orientation, wherein said roller is on said vehicle with the weight of said roller being substantially borne by a chassis of said vehicle directly, rather than via said pivot arm means, and a use orientation, wherein said roller is in an open top container with the weight of said roller being substantially borne by the trash in the open top container;

whereby rotation of said roller causes said roller to move along the interior length of the open top container and thereby shred, redistribute and compact trash therein.

2. The pulverizer of claim 1 wherein said pulverizer effects a 5:1 volumetric compaction of trash.

3. The pulverizer of claim 1 wherein said roller has a weight of at least 1,000 lbs and an axial length of about 6 feet.

4. In combination, the pulverizer of claim 1 and an open top container containing trash.

5. The pulverizer of claim 1 wherein said pivot arm means comprises:

(i) a stationary mast having a first end fixedly secured to said vehicle and a second end projecting distally upwardly thereof;

(ii) a first arm having a first end pivotally secured to said second end of said mast and a second end extending distally thereof; and (iii) a second arm having a first end pivotally secured to said second end of said first arm and a second end extending distally thereof and secured to said roller.

6. The pulverizer of claim 5 additionally including arm attachment means for releasably locking together said first and second arms, said arm attachment means being operative during movement of said roller between said transport and use orientations and during motion of said vehicle.

7. The pulverizer of claim 6 wherein said arm attachment means is a pintle hook-and-eye system, including a manually releasable lock on the hook.

8. The pulverizer of claim 5 wherein said first arm defines a dogleg adjacent said first end thereof such that, when said first arm is in a generally upright orientation, said second arm second end is closer to the front of said vehicle than it would be without the dogleg, thereby to enable said roller in the open top container to reach closer to the proximal end of the open top container and, when said first arm is in a generally horizontal orientation, said roller to be in the transport orientation.

9. The pulverizer of claim 5 wherein said vehicle has a front axle mounting a pair of wheels and two rear axles, each rear axle mounting a pair of wheels, said mast means being mounted on said vehicle intermediate the two rear axles and inboard of said rear axle wheels.

10. The pulverizer of claim 5 wherein said pivot arm means is configured and dimensioned to enable said roller to move to-and-fro along substantially the entire interior length of the container at the height of the interior floor of the container.

11. The pulverizer of claim 5 wherein, when said roller is in the transport orientation, the junction of said first arm and said second arm projects rearwardly behind the back of said vehicle by not more than ⅔ of the wheel base of the vehicle and the maximum height of the vehicle is less than 13 feet, 9 inches above the ground.

12. The pulverizer of claim 5 additionally including means for enabling limited free pivotal movement of said second arm relative to said first arm and said first arm relative to said mast, such that said roller can move to-and-fro along the interior length of the open top container.

13. The pulverizer of claim 5 additionally including a manually actuatable hydraulic ram having a first end pivotally mounted on said mast and a reciprocating second end operatively secured to said first arm for raising and lowering the same.

14. The pulverizer of claim 13 additionally including a paddle having two opposed ends and a center therebetween, one end of said paddle being pivotally secured to said ram second end, the center of said paddle being pivotally mounted on said mast second end, and the opposite end of said paddle freely bearing against said first arm first end, whereby said paddle allows said first arm second end to freely float upwardly and downwardly relative to said mast while limiting the effect of upward movement of said ram second end.

15. The pulverizer of claim 13 wherein said first arm adjacent said second end thereof and said second arm adjacent said first end thereof cooperatively define facing arm bumpers projecting toward one another to prevent said roller from contacting said mast and said ram.

16. In combination, the pulverizer of claim 13 and an open top container containing trash.

17. The pulverizer of claim 1 wherein said vehicle defines at the upper rear thereof a gatorback formed of a plurality of transversely extending ridges increasing in height toward the front of said vehicle, whereby, when said roller is properly positioned and rotating in the proper direction, said roller will at least partially crawl up said gatorback.

18. A mobile trash pulverizer for shredding, redistributing and compacting trash in an open top container, comprising:

(A) a self-propelled vehicle configured and dimensioned for lawful travel on a public street or highway, at or above a legal minimum speed, between a plurality of remote trash collection sites having open top containers containing trash to be pulverized;

(B) a rotatable, generally cylindrical, heavy roller defining a pair of opposed ends and a circumferential surface connecting said ends, said roller having a plurality of spaced apart cutters projecting outwardly from said circumferential surface for pulverizing trash during rotation of said roller;

(C) means for reversibly rotating said roller; and (D) pivot arm means carried by said vehicle for supporting and moving said roller between a rest orientation, wherein said roller is on said vehicle with the weight of said roller being substantially borne by a chassis of said vehicle directly, rather than via said pivot arm means, and a use orientation, wherein said roller is in the open top container with the weight of said roller being substantially borne by the trash in the open top container;

whereby rotation of said roller causes said roller to move along the interior length of the open top container and thereby shred, redistribute and compact trash therein.

19. In combination, the pulverizer of claim 18 and an open top container containing trash.

20. The pulverizer of claim 18 wherein said pivot arm means comprises:

(i) a stationary mast having a first end fixedly secured to said base and a second end projecting distally upwardly thereof;

(ii) a first arm having a first end pivotally secured to said second end of said mast and a second end extending distally thereof; and (iii) a second arm having a first end pivotally secured to said second end of said first arm and a second end extending distally thereof and secured to said roller;

said first arm defining a dogleg adjacent said first end thereof such that, when said first arm is in a generally upright orientation, said second arm second end is closer to the front of said mast than it would be without the dogleg, thereby to enable said roller in the open top container to reach closer to the proximal end of the open top container and, when said first arm is in a generally horizontal orientation, said roller to be in the rest orientation;

said pivot arm means being configured and dimensioned to enable said roller to move to-and-fro along substantially the entire interior length of the container at the height of the interior floor of the container.

21. The pulverizer of claim 20 additionally including (E) means for enabling limited free pivotal movement of said second arm relative to said first arm and said first arm relative to said mast, such that said roller can move to-and-fro along the interior length of the open top container;

(F) a manually actuatable hydraulic ram having a first end pivotally mounted on said mast and a reciprocating second end operatively secured to said first arm for raising and lowering the same; and (G) a paddle having two opposed ends and a center therebetween, one end of said paddle being pivotally secured to said ram second end, the center of said paddle being pivotally mounted on said mast second end, and the opposite end of said paddle freely bearing against said first arm first end, whereby said paddle allows said first arm second end to freely float upwardly and downwardly relative to said mast while limiting the effect of upward movement of said ram second end.

22. The pulverizer of claim 18 wherein said vehicle defines at the upper rear thereof a gatorback formed of a plurality of transversely extending ridges increasing in height toward the front of said vehicle, whereby, when said roller is properly positioned and rotating in the proper direction, said roller will at least partially crawl up said gatorback.

* * * * *